US005088186A

United States Patent [19]

Boesel

[11] Patent Number: 5,088,186

[45] Date of Patent: Feb. 18, 1992

[54] METHOD OF MAKING A HIGH EFFICIENCY ENCAPSULATED POWER TRANSFORMER

[75] Inventor: Robert P. Boesel, St. Paul, Minn.

[73] Assignee: Valentine Engineering, Inc., St. Paul, Minn.

[21] Appl. No.: 492,821

[22] Filed: Mar. 13, 1990

[51] Int. Cl.[5] ..... H01F 41/02

[52] U.S. Cl. ..... 29/605; 29/606; 29/609; 264/272.14; 264/272.2; 336/96

[58] Field of Search ..... 29/609, 605, 602.1, 29/606; 264/272.14, 272.20; 336/96

[56] References Cited

U.S. PATENT DOCUMENTS

| | | | |
|---|---|---|---|
| 2,141,141 | 12/1938 | Kongsted | 336/96 X |
| 3,201,728 | 8/1965 | McWhirter | 336/96 X |
| 3,240,848 | 3/1966 | Burke et al. | 264/272.19 |
| 3,626,051 | 12/1971 | Liautaud . | |
| 3,626,587 | 12/1971 | Zickar et al. . | |
| 3,914,658 | 10/1975 | Holden et al. | 336/96 X |
| 4,199,743 | 4/1980 | Martincic . | |
| 4,307,365 | 12/1981 | Martincic . | |

FOREIGN PATENT DOCUMENTS

| | | |
|---|---|---|
| 2121464 | 8/1972 | France . |

*Primary Examiner*—Carl E. Hall
*Attorney, Agent, or Firm*—Merchant, Gould, Smith, Edell, Welter & Schmidt

[57] ABSTRACT

A power transformer apparatus and method for making the same. The unitary bobbin retains core laminations during a core compaction process. The compacted core is sandwiched between two molds during the encapsulation process producing an improved transformer structure.

4 Claims, 3 Drawing Sheets

FIG. 1A
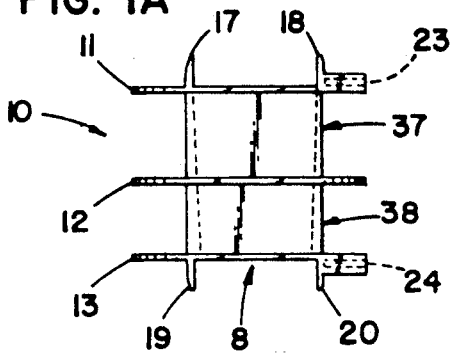
FIG. 1B
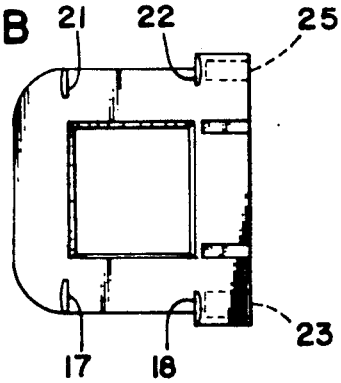
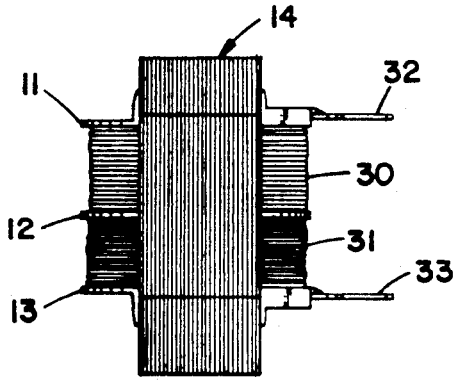
FIG. 2A
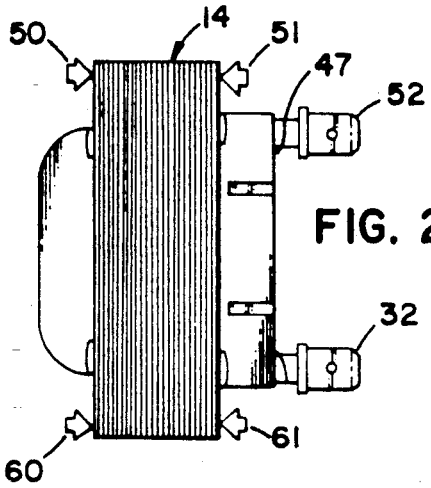
FIG. 2B
FIG. 3
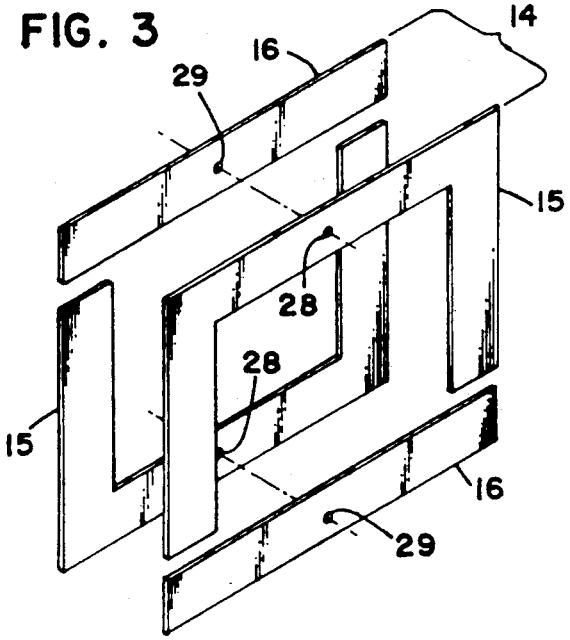
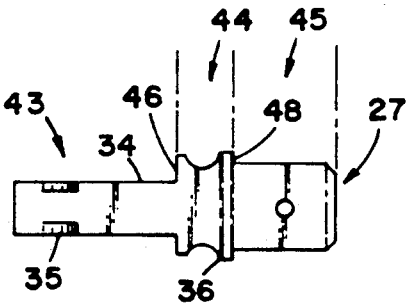
FIG. 4
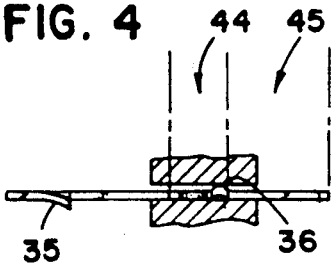
FIG. 5

METHOD OF MAKING A HIGH EFFICIENCY ENCAPSULATED POWER TRANSFORMER

BACKGROUND OF THE INVENTION

1. Field of The Invention

The present invention relates to power transformers and more particularly to an encapsulated transformer construction which exhibits high electromagnetic efficiency.

2. Brief Description of The Prior Art

Power transformers are widely used for voltage conversion. Transformers include primary and secondary windings which are physically separated from each other. The windings are coupled electromagnetically through a ferromagnetic core.

Various construction techniques have been adopted to meet the mechanical and electrical requirements of various transformer designs.

For example, the prior art teaches:

The use of a unitary bobbin having three flanges which permits the winding of both primary and secondary coils on the same bobbin. The aperture of the bobbin fits over the middle leg of an E-core transformer windings.

The use of injection molding encapsulation for paper wound fly back transformers and the like is taught by U.S. Pat. No. 3,626,051.

The encapsulation of current transformers is known from Martincic U.S. Pat. No. 4,199,743.

Each of these prior art inventions addresses the numerous problems which must be overcome to encapsulate a transformer assembly. However, in the prior art encapsulation of power type transformers has not performed. It is known that power transformers are not perfectly efficient and that resistive losses in the windings result in the generation of heat in the transformer assembly. Other sources of heat include core losses which result in heating of the core material. It has been conventional to expose as much of the windings as practical to the air as an aid in the dissipation of this heat.

SUMMARY OF THE INVENTION

In contrast to the prior art, the present invention teaches a power transformer design, and construction technique which results in a substantially fully encapsulated transformer. Both the mechanical design, and assembly method result in the improved encapsulated transformer.

The construction uses a three flange bobbin to locate and retain E and I core lamination during mechanical assembly operations. The three flanges may be spaced to provide a "wide" winding form and a "narrow" winding form which are adjacent to each other.

The bobbin aperture which fits around the center leg of the transformer core member, has tapered walls. The taper has both electrical and mechanical significance.

Electrically, the taper may be used to place more dielectric material between the magnetic core material and the windings wrapped on the form proximate the small end of the taper. Typically the transformer will be designed with the high voltage winding on the small end of the taper.

Mechanically, the taper permits the selective assembly of alternating core pieces into the bobbin and permits retention of these core pieces by compression during subsequent manufacturing operations.

The "assembled" transformer is placed between two injection molds wherein the transformer core becomes a third mold element.

In this context an "assembled" transformer consists of a core with completed windings having the required magnetic core material assembled into the tapered aperture.

The core with completed windings includes electrical termination connectors. These elements serve a dual function as well. The connectors are physically retained in slots formed in the unitary bobbin. The connectors are soldered or otherwise connected to the windings in a conventional fashion to electrically couple the windings to the connectors.

The connectors each have a specialized sealing structure which prevents flashing of plastic out of the mold during the injection process, yet permits the venting of air from the mold.

The injection of thermoplastic material into the mold cavity through windows formed by the bobbin results in a transformer with substantially completely encapsulated windings and results in a mechanically stable structure which provides improved mechanical, electrical and thermal properties.

Mechanically, the compaction of the core lamination by the injection mold platens during injection results in a conformal plastic clamp which retains the core in the compacted state after removal from the mold. This feature eliminates transformer "buzzing" and improves the electrical performance of the transformer as well.

Electrically, the alternating assembly of E and I cores as well as the compaction reduces the air gaps associated with the transformer core material, which improves magnetic performance.

Thermal performance is enhanced by the reduction in resistive and magnetic losses coupled with the improved thermal conductivity provided by the encapsulant.

BRIEF DESCRIPTION OF THE DRAWING

In the drawing, in which like reference numerals indicate corresponding structures throughout the views:

FIG. 1A is an elevational view of the bobbin;

FIG. 1B is a top view of the bobbin;

FIG. 2A is an elevational view of the core lamination assembled onto the bobbin;

FIG. 2B is a top view of the core lamination assembled onto the bobbin;

FIG. 3 is a perspective view of the core lamination;

FIG. 4 is a top view of a quick connect tab used for electrical connection to the windings;

FIG. 5 is a side elevation view of a quick connect tab used for electrical connection to the windings;

DETAILED DESCRIPTION OF THE PREFERRED EMBODIMENT

In the following detailed description of the preferred embodiment, reference is made to an illustrative embodiment of the invention. It is to be understood that other embodiments may be utilized without departing from the scope of the present invention.

OVERVIEW OF THE INVENTION

The transformer structure is based upon a unitary bobbin shown in FIG. 1. The bobbin has three flanges forming two winding forms shown in FIG. 1A as 37 and 38. Wire is wound on these forms forming the transformer primary and secondary windings as shown as 30 and 31 in FIG. 2A. The windings are typically terminated in four electrical connections shown in the figures as 32,33,52,53. The terminals 27 have a sealing structure 36 shown in connection with FIG. 4 and FIG. 5.

Figure 6A:
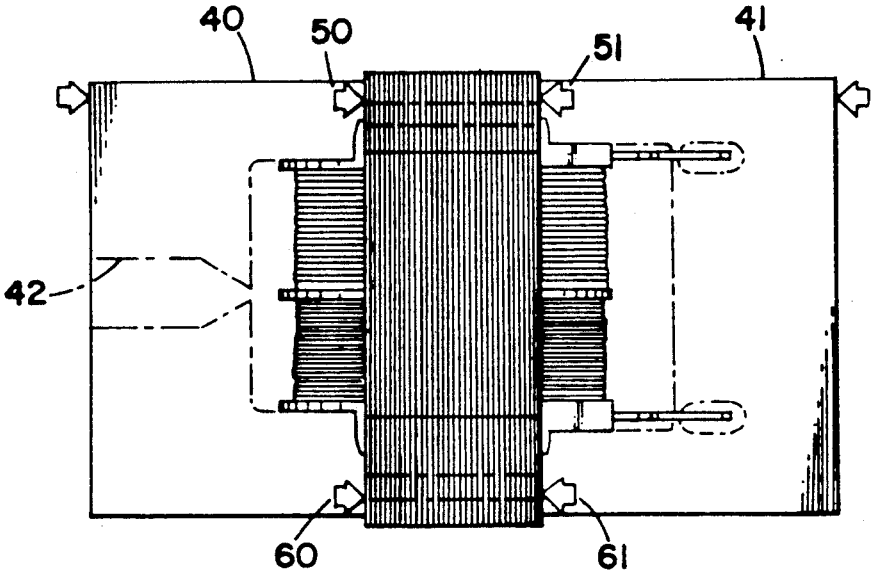
FIG. 6A is a schematic side elevation view of the two piece mold having a transformer core positioned for the molding operation.
Figure 6B:
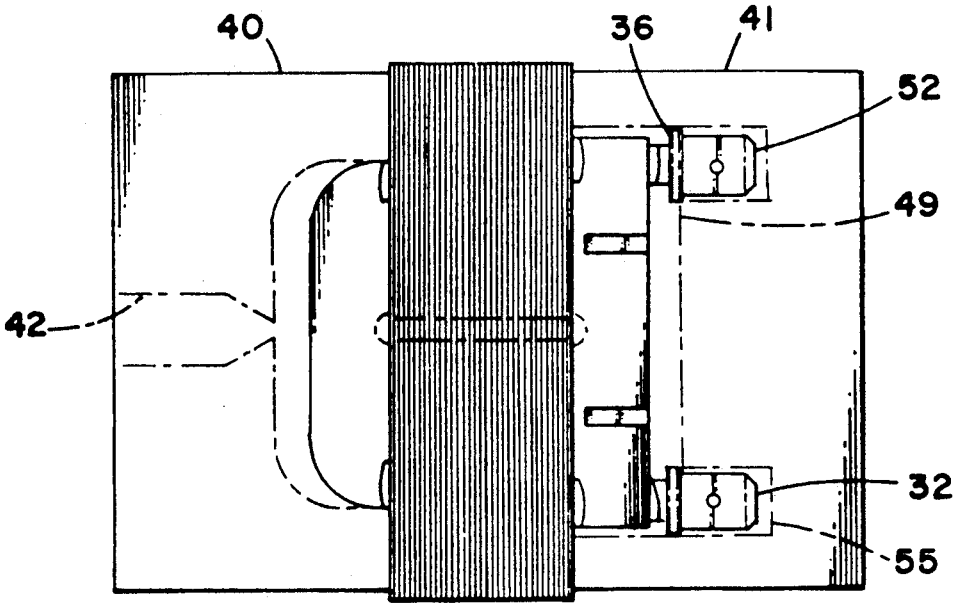
FIG. 6B is a schematic top view of the two piece mold having a transformer core positioned for the molding operation.
Figure 7:
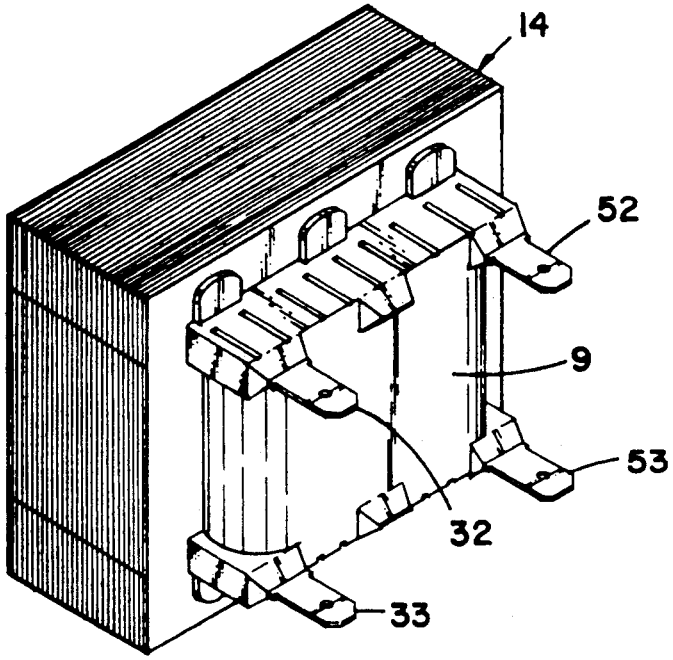
FIG. 7 is a perspective view of a completed transformer.

The "assembled" transformer as depicted in FIGS. 2A and 2B is loaded into an injection molding machine which is depicted schematically in FIGS. 6A and 6B. After the completion of the molding process, the "finished" transformer, as shown in FIG. 7, is ejected. The interior surface of the injection mold follows the general contours of the bobbin closely so that the encapsulation process results in a substantially conformal coating of the bobbin.

In the "finished" transformer the core laminations 14 are exposed. The electrical terminals are also exposed for electrical connection while the primary 30 and secondary 31 windings are substantially completely encapsulated by the plastic material 9.

The preferred encapsulant material a polyethylene terephthalate material sold by DuPont, of Delaware under the tradename "Rynite".

TRANSFORMER ASSEMBLY

Briefly, the stepwise sequence for assembling the transformer involves first winding the high voltage 30 and low voltage 31 windings onto the specialized three flange bobbin 10.

The bobbin 10 has four retainer slots 23–26 for positioning and retaining four electrical terminals—32, 33, 52, 53—. The terminals are inserted into the slots and they are electrically connected to the windings.

The bobbin has a tapered core receiving aperture 8, which permits numerous individual core sections 15 and 16 to be assembled into the bobbin filling the bobbin core receiving aperture 8. Selective assembly of alternating core sections is followed by a compaction process. The compaction process may be performed with a specialized fixture which is similar in configuration to the molds 40 and 41. The compaction process is followed by the insertion of additional core pieces which results in a very tight fit between the core sections and the bobbin which permits the bobbin aperture to be substantially completely filled. Two benefits result from the selective insertion of additional core material after compaction. The first benefit is that the air gaps between the separate pieces of the core are greatly reduced which improves the magnetic performance of the transformer. The second benefit is that the winding form has a greater weight of magnetic material encompassed within its electric field resulting in improved current utilization by the transformer.

Compaction and the subsequent insertion of supplemental core pieces can be exploited in another way as well. In general magnet steel is supplied in varying grades. Cold rolled steel is the lowest grade with silicon steel and grain oriented silicon steel representing higher performance materials per unit weight. In the present invention is contemplated the grades of steel maybe mixed to achieve a requisite level of performance. Mixing grades may be used to control the price performance characteristics of the completed transformers.

Completely filling the aperture permits the bobbin to retain, locate and position the transformer elements for the injection molding step. The completion of the core insertion process produces a freestanding and electrically complete transformer, which is ready for injection molding. This freestanding transformer is referred through the specification as an "assembled" transformer.

The individual design features and manufacturing steps described briefly above may be understood in greater detail as follows:

FIG. 1 shows the bobbin 10. The bobbin has first 11 second 12 and third 13 flanges. The flanges form two spools for receiving windings. For example, in the illustrative design shown herein, the wider spaced spool may be used for the higher voltage winding, while the narrower spool may be used for the lower voltage winding. The bobbin has a hollow core which is shown in an phantom view. The taper of the hollow core is exaggerated for clarity and illustrates the there will be a greater amount of insulating core material between the high voltage winding and the ferromagnetic core material. The taper is required to permit manual assembly of the core laminations into the bobbin 10. Although a linear taper of all four walls of the aperture is shown in the figure it should be appreciated that the taper can take other forms as well.

FIG. 2A shows the spools wound with their appropriate windings. The high voltage winding 30 ends in leads which are soldered or otherwise connected to the terminal connectors 26 and 32. The lower voltage winding 31 likewise is terminated in corresponding connectors.

E-cores and I-cores are assembled into the spool. It is preferred to stack the E and I cores alternately so that each I-core lies between adjacent E-core segments. This configuration is depicted in FIG. 3.

FIG. 3 shows each core segment having an aperture 28 or 29 located therein. Typically these apertures are produced by the lamination stamper and are used to locate the pieces during manufacture and shipping. It is desirable to fill the bobbin with the maximum number of laminations. This is desirable in the present instance for both mechanical and electrical reasons.

Electrically, transformer performance is enhanced by the inclusion of additional core material within the aperture 8.

Mechanically, the transformer may be easily handled for subsequent processing if the core laminations are firmly secured within the bobbin. This desirable condition is achieved by selective assembly of the core structure. The selective assembly process results in the elastic deformation of the lamination pieces such that they are held into position. The alternation of E and I core segments called for by this assembly technique coupled with the burrs on the E and I core segments in conjunction with the assembly process result in a core structure which is thicker at the edges than at the middle. This bowed structure is accentuated in the core 14 depicted in FIG. 2B.

E and I core sections 16 and 15 are created by a stamping operation. Stacks of these cores are used to assembly transformer frames. Typically transformers are manufactured according to industry standard frame sizes a typical "one inch" stack height transformer core would have between 0.85 and 0.95 inches of solid steel.

In practice, processing variations of the core materials results in variable thicknesses and therefor a variable stack height. These variations are due to thickness variations and stamping burrs. Two distinct arrises form on the surface of the stamped core section. These two distinct conditions are called "rollover" and "burr".

The rollover arris is the result of material deformation as the stamping punch enters the material and is characterized as a "rounded edge".

The burr arris is the result the force applied by the stamping punch exceeding the shear strength of the material and is characterized as a raised "sharp edge". The surface of the lamination between the arris, has two conditions known as "land" and "breakout". The land portion is characterized by a shiny, relatively smooth but striated condition, while the breakout portion is characterized by a dull, rough surface. It is important to note that the land and breakout surfaces are not coplanar and the breakout surface is especially not perpendicular to the rolled surface of the lamination. Thus, even if one stacks lamination in perfect registration, the surfaces produces by stacking will be highly irregular as a result of the nature of the stamping process.

The burr arris exhibits a protrusion of material above the plane of the rolled surface of the lamination. Thus, a thickness measurement including the burr arris within the anvils of the micrometer will exceed a similar measurement where the anvils are totally within the stamped shape. When the "E" and "I" components are assembled in alternating fashion in accordance with the teaching of this invention, the burr on each core section 14 and 15 adds to the volume of the core as it is assembled. Traditionally, this occurrence is known as "stacking factor", and is usually expressed as a percentage of the volume within a core assembly which is composed of iron or other magnetic metal, the balance void of magnetic material as a result of the accumulation of burrs on the components. The stacking factor is a material consideration in the design of the transformer since it is the cross sectional area of the magnetic material which determines how much magnetic flux can be conducted for any particular magnetic material. Stacking factors on the order of 85% are not uncommon.

A less efficient prior solution to the stacking problem has been to stack a number of E cores together and to weld a like number of I cores to form a transformer frame. In contrast the present invention alternates E and I cores to achieve magnetic efficiency while reducing undesirable air gaps.

A second condition adds to the detrimental effects caused by the stacking factor, and that is that the individual lamination are never perfectly flat. The steel sheet used for producing lamination is produced by rolling, and then wound into coils for stowage and shipment. The coiled sheet develops a curvature parallel to the rolling direction which remains even after the coil is unwound called "coil set". The coil also develops a curvature perpendicular to the rolling direction called "camber". Before the material is stamped into individual lamination components, the rolled coil must be slit to the width required by the particular stamping die to be employed. The coil is unrolled for the slitting process, and the individual coils are rerolled after slitting. The slitting process itself can add to the out-of-flat condition.

An attempt is made to flatten the surface of the stock prior to stamping through the use of stock straighteners which employ opposing rolls to alternately cause the stock to bend first one direction and then the other, in decreasing amounts until the stock emerges from the straightener in a more flat condition.

The stock is then stamped into individual lamination components, with the stamping process contributing to additional out of flat condition as well as the tendency for some lamination features to be bent out of the plane of the balance of the component. It is important to note that the lamination components are collected in sequence and orientation as they are stamped, with lots of lamination so produced retained by wire strung through holes stamped for this purpose.

In most cases, an annealing process is performed on the lamination to relieve the stress induced in the material by previous processing. This process can also contribute to a condition of curvature.

The end result of the curvature of the lamination components is that additional voids in the magnetic core exist, reducing the performance and efficiency of the transformer.

The negative effects of the stacking factor associated with the accumulation of burrs is avoided in this design by employing a compaction process wherein the assembled transformer is placed in tooling designed for the purpose of applying a force parallel to the stack height sufficient to cause the raised burr arris to be flattened down to the rolled plane of the lamination surface. Any burr arris on the exterior of the core assembly is deformed directly by the tool surface, while those burr arises within the core are deformed by the rolled surfaces of the lamination with which they are in contact. The fact that the lamination are usually annealed to a fully soft state after stamping contributes to the effectiveness of this process.

In cases where there is relatively significant void due to stacking factor attributable to the burr arris as a result of a large number of layers or a relatively high burr arris, the lamination compaction factor can be performed in machinery dedicated to this purpose after which additional lamination can be assembled into the volume vacated by the burr arises. In cases where there is so little volume occupied by the burr arises as a result of a low number of lamination with very low burr arises that no additional lamination could be added, the compaction process can be performed immediately prior to injection of the encapsulant in the plastic molding process.

With the burr arises deformed from their position above the rolled plane of the lamination, additional lamination can be assembled to eliminate the stacking factor component due to out of flat condition of the lamination. This is easily overcome as the addition of the last lamination wedge their way into the assembly, with friction due to the compression attributable to the burr arises eliminated. Now, the available volume within the coil assembly is much more fully occupied by the magnetic material intended to fill this space.

FIG. 2B depicts the compaction process schematically by force vectors 50 and 51, and 60 and 61. In practice a fixture which conforms to the laminated core 14 shape will be used to compress the core lamination to compact the core 14 and to permit the selective assembly of more core material into the aperture 8 than would be possible without compaction.

A further securing of the lamination against any movement or vibrations occurs as a result of the encapsulant conforming intimately to the irregular surface formed by the assembly of the lamination as a result of the high pressure employed in the plastic molding process.

TRANSFORMER MOLDING PROCESS

The encapsulation process is preferably accomplished by injection molding as depicted in connection with FIG. 6A and 6B. This molding process uses the transformer core as a portion of the mold. The mold faces apply force 50,51,60,61 to compress the core during the molding process. This compaction during molding technique serves to further reduce the air gaps associated with the interleaved core laminations and improves the magnetic performance of the finished transformer. The use of the transformer core as a mold element also permits unusually low injection pressures. The small gaps resulting from the non-perpendicular breakout surfaces permits the escape of air from the mold cavity which permits relatively low injection pressures.

The thermoplastic material is softened in the barrel of a conventional injection molding machine and is then injected into the mold cavity formed by the mold halves in conjunction with the transformer core. The thermoplastic may be heated to approximately 500 degrees F., and the injection pressure may range from 100 to 3000 psi. Once the mold is filled the pressure in the melt or, holding pressure may be increased to approximately 5000 to 10000 psi, with a mold temperature of 210 degrees F.

In general, the optimum molding parameters will depend on the particular transformer size under construction and the particular injection molding machinery used for the shot.

The injection molding process completes mechanical and electrical assembly of the transformer and results in an improved transformer exhibiting improved mechanical and thermal performance characteristics.

The encapsulant mechanically locks the core section into position and prevents the individual lamination from moving and causing transformer buzz.

The encapsulant protects the wire of the windings from the environment. The encapsulant also operates as an insulator providing electrical isolation between various transformer elements.

The encapsulant also provides thermal interconnection between the electrically isolated transformer elements which improves heat dissipation to the environment.

FIG. 6A shows an assembled transformer loaded into the molding cavity of an injection molding mould. The mould has a front half 41 and a rear half 40. The core lamination abut the mold halves and space them apart during the molding operation. This effectively makes the transformer assembly a portion of the mold. This molding technique places the core laminations under compaction pressure during the molding process as shown in FIG. 6A by force vectors 60 and 61. The compaction pressure and resulting static friction prevent the injection pressure from springing the core. It appears that the compaction process during the molding shot also reduces air gaps in the laminated core structure which then remain mechanically locked after the encapsulant solidifies.

It is important to seal the mold against leakage or "flashing". The high clamping force between the molding platens forces the mould halves into contact with the annealed iron laminations providing an effective seal which prevents flashing between the core laminations and the parting faces of the mould. Flashing is prevented proximate the electrical termination by the use of specialized structures on the terminals 27. In use these specialized sealing structures perform two functions. First they permit air to escape from the mold ensuring that no bubble is formed in the mold at the electrical terminal. Secondly, the sealing structure prevents leakage from the mold along the contact surface of the connector.

FIGS. 4 and 5 show these sealing structures. Each terminal comprises a tang portion 43; a notched portion 44; and a connection portion. After encapsulation the tang and notched portions are substantially completely covered by encapsulant while the connection portion is free of encapsulant. During assembly the tang is inserted into the appropriate slot until the tang flange 46 abuts the unitary bobbin body. During the soldering operation a wrap of the winding wire is placed in the notched potion of the terminal and soldered to the terminal 27, as shown at the soldered joint 47 shown in FIG. 2B.

Two approaches may be taken to prevent expressing the terminal 27 into the mold 41 during a shot. First, the "assembled" transformer may be placed in the mold halves as shown in FIG. 6B, where the connector tip flange 48 abuts a cooperating surface on the mold 41 shown in FIG. 6B as 49. Under the pressure of injection these connector flange features prevent the terminals from being expressed into the mold 41. A second approach is to have the terminal connector tip 54 bottom out in the mold recess as shown at 55 in FIG. 6B.

In either case, plastic flow is prevented by the sealing ridge 36 which is raised in the terminal material during manufacture. It has been determined that the sealing ridge height must be controlled to a total clearance between the sealing ridge 36 and the mold 41 of approximately 0.001 inch.

In general the accumulated tolerances in the coil bobbin assembly prevent direct insertion of the terminals into the mold recesses. Therefore some flexibility is provided in the terminal bobbin assembly to permit guiding and relocating of the terminals as they are placed into the mold 41.

Since the mold recess is used to relocate the terminals 27, it must be assumed that a residual force will remain, which force will generally assure that the total clearance provided between the mold recess and the terminal seal volume represented by sealing ridge 36, will occur on one side of the two axes describing the plane beyond which the encapsulant must not flow. Thus, the practical clearance allowable to allow insertion but still prevent the flow of plastic is only half of what it would be if the terminal were centered in the recess. This varies with the nature of the encapsulant, and is exceeded by the tolerance of the rolled stock from which the terminals 27 are stamped. Therefore it is preferred to raise a sealing ridge 36 during the stamping process and to then subsequently press the terminals between platens to reduce the ridge height to a well controlled dimension resulting in a well controlled sealing volume. Although any of a variety of metal working processes could be employed to create the sealing ridge it is preferred to raise the ridge during the stamping of the terminal and to employ a subsequent flatting step in the stamping die to produce a controlled ridge height.

In operation the hot thermoplastic is injected under pressure into the injection port 42. The plastic flows around the bobbin and through windows formed between the bobbin and the windings of the transformer.

The high injection pressures force the plastic into conformity with the interior of the core lamination and the windings. This results in good conformity between the plastic and the iron core material and the transformer wingdings.

The intimate contact between the core and the windings results in good heat transfer between these elements. Separation of the core lamination in the completed transformer is prevented by the "sprue rivet" formed by the entry of plastic into the stacked lamination apertures 29. The molding process fills this void effectively mechanically coupling the core material to the encapsulant.

Prior art transformers of normal efficiency run quite "hot" under load. Typically the windings operate at 115 degrees C., while the core material operates at a temperature of 85 degrees C. Test transformers of the configuration depicted in FIG. 7 have a substantially more uniform temperature distribution and operate at a temperature of 105 degrees C. on the surface of the encapsulant and 95 degrees C., at the core surface.

This important decrease in operation temperature results from improved thermal transfer within the transformer assembly and improved electrical performance resulting from the design characteristics of the transformer.

The design features result in the packing of a maximum amount of core material within the bobbin as well as the reduction of the air gaps associated with the lamination assembly.

What is claimed is:

1. A method of making an encapsulated transformer comprising the steps of:

a. forming a unitary bobbin having a central bobbin aperture, the bobbin aperture having tapered walls;

b. forming a first and second winding on the unitary bobbin;

c. connecting the first and second windings to electrical terminals;

d. successively inserting a central portion of an E-core piece into the tapered bobbin aperture, thereby forming layers of E-core pieces;

e. joining a mating I-core piece to each E-core piece;

f. continuing the insertion and mating of the core pieces at least until mechanical deformation of the core pieces occurs, whereby the core pieces and the unitary bobbin together form a self supporting core structure;

g. inserting additional E-core pieces into the tapered bobbin aperture so as to substantially completely fill the tapered bobbin aperture, thereby forming an assembled transformer;

h. compressing the assembled transformer between conformed molds by applying force to the core pieces; and i. injecting thermoplastic encapsulant into a mold cavity formed by the conformed molds, thereby forming compressed windings that are mechanically and thermally bonded to the core pieces.

2. The method of claim 1 wherein some layers of E-core material are formed from different grades of magnetic material than other layers of E-core materials.

3. The method of claim 1 wherein:

said encapsulant is a polyethylene terephthalate material.

4. A method of molding a high efficiency power transformer comprising the steps of:

a. forming a unitary bobbin having a tapered central bobbin aperture;

b. forming a first and second winding on the unitary bobbin;

c. connecting said windings to terminals;

d. assembling laminations into said bobbin forming an assembled transformer by;

d1. inserting a central portion of E-core pieces into the tapered central bobbin aperture until at least some portion of the E-core pieces are mechanically deflected, whereby said E-core pieces and said unitary bobbin together form a self supporting core structure;

d2. compacting said self supporting core structure;

d3. inserting addition E-core pieces into the tapered central bobbin aperture;

e. placing said assembled transformer between conformal molds, wherein at least a portion of said core member is exposed;

f. injecting thermoplastic encapsulant into said mold into conformity with said mold cavity and said core laminations.

* * * * *